US011358748B2

(12) United States Patent
Warren

(10) Patent No.: US 11,358,748 B2
(45) Date of Patent: Jun. 14, 2022

(54) BOX FOR LUMINAIRE AND METHOD FOR INSTALLING LUMINAIRE

(71) Applicant: TRIDONIC GMBH & CO KG, Dornbirn (AT)

(72) Inventor: Barry Warren, Spennymoor (GB)

(73) Assignee: Tridonic GmbH & Co KG, Dornbirn (AT)

( * ) Notice: Subject to any disclaimer, the term of this patent is extended or adjusted under 35 U.S.C. 154(b) by 247 days.

(21) Appl. No.: 16/480,356

(22) PCT Filed: Mar. 28, 2018

(86) PCT No.: PCT/EP2018/058000
§ 371 (c)(1),
(2) Date: Jul. 24, 2019

(87) PCT Pub. No.: WO2018/184958
PCT Pub. Date: Oct. 11, 2018

(65) Prior Publication Data

US 2021/0276759 A1 Sep. 9, 2021

(30) Foreign Application Priority Data

Apr. 6, 2017 (GB) ..... 1705829

(51) Int. Cl.
*B65D 5/42* (2006.01)
*B65D 5/52* (2006.01)
(Continued)

(52) U.S. Cl.
CPC ..... *B65D 5/4208* (2013.01); *B65D 5/52* (2013.01); *B65D 81/368* (2013.01); *B65D 85/42* (2013.01); *F21V 21/04* (2013.01)

(58) Field of Classification Search
CPC ..... B65D 5/4208; B65D 5/52; B65D 81/368; B65D 85/42; B65D 5/44; B65D 25/22;
(Continued)

(56) References Cited

U.S. PATENT DOCUMENTS 1,124,122 A * 1/1915 Foyle ..... B65D 85/42 206/418
2,067,126 A * 1/1937 Knaur ..... B65D 5/5011 206/418
(Continued)

FOREIGN PATENT DOCUMENTS

DE 3702688 8/1987
DE 20109884 9/2001
(Continued)

OTHER PUBLICATIONS

Great Britain search report in priority GB Application 1705829.8 dated Oct. 6, 2017.
(Continued)

*Primary Examiner* — J. Gregory Pickett
*Assistant Examiner* — Jenine Pagan
(74) *Attorney, Agent, or Firm* — Andrus Intellectual Property Law, LLP

(57) ABSTRACT

The present invention relates to a box (1) for receiving a luminaire (10), comprising a box body (2) delimiting a space (3) for receiving and supporting a luminaire (10) within the box body (2), an opening (4) delimited by a circumferential edge (5) of the box body (2) for putting the luminaire (10) into and taking the luminaire (10) out of the box (1), and a tap (6) for hanging-up the box (1) carrying the luminaire (10) at a corresponding receiving section. The tap (6) comprises a connection portion (7) extending from the box body (2), and a hanger portion (8) being distant from the box body (2) and laterally extending from the connection portion
(Continued)

Step 1

Step 2

(7). The present invention further relates to a method for installing a luminaire (10), in particular a built-in luminaire (10) which is providing within a box (1) according to the present invention supporting said luminaire (10) within the space (3) of its box body (2).

16 Claims, 2 Drawing Sheets

(51) Int. Cl.
*B65D 81/36* (2006.01)
*B65D 85/42* (2006.01)
*F21V 21/04* (2006.01)

(58) Field of Classification Search
CPC ..... B65D 85/00; F21V 21/04; F21V 21/02; F21V 21/08; F21S 8/00
USPC ..... 206/418, 806
See application file for complete search history.

(56) References Cited

U.S. PATENT DOCUMENTS 2,486,045 A * 10/1949 Madden ..... B65D 5/46048 229/117.24
3,510,047 A * 5/1970 Boehm ..... B65D 5/5455 229/147
3,539,091 A * 11/1970 Murray ..... B65D 5/5009 206/418
3,907,104 A 9/1975 Taub
4,162,779 A 7/1979 Van Steenhoven
4,579,226 A * 4/1986 Blake ..... B65D 5/5059 206/593
4,749,083 A * 6/1988 Growney ..... B65D 5/10 206/418
4,921,099 A * 5/1990 Trauschke ..... B65D 5/0245 206/418
5,236,122 A * 8/1993 Ballard ..... B65D 5/6664 229/102
6,752,263 B2 * 6/2004 Dubsky ..... B65D 5/241 206/216
2004/0169067 A1 * 9/2004 Chen ..... B65D 5/4208 229/120.17

FOREIGN PATENT DOCUMENTS

| | | |
|---|---|---|
| EP | 0464365 | 1/1992 |
| FR | 2508782 | 1/1983 |
| FR | 2808780 | 11/2001 |
| GB | 27861 | 11/1914 |
| JP | S5056467 | 5/1975 |
| JP | H09164045 | 6/1997 |
| JP | 2008265841 | 11/2008 |

OTHER PUBLICATIONS

PCT ISR in parent PCT Application PCT/EP2018/058000 dated Jun. 8, 2018.

* cited by examiner

Step 1

Step 2

Step 3a

Step 3b

Step 4

Step 5

BOX FOR LUMINAIRE AND METHOD FOR INSTALLING LUMINAIRE

CROSS REFERENCE TO RELATED APPLICATIONS

The present application is the U.S. national stage application of international application PCT/EP2018/058000 filed Mar. 28, 2018, which international application was published on Oct. 11, 2018 as International Publication WO 2018/184958 A1. The international application claims priority to Great Britain Patent Application 1705829.8 filed Apr. 6, 2017.

FIELD OF THE INVENTION

The present invention relates to a box for receiving a luminaire as well as a method for installing a luminaire, in particular a built-in luminaire, provided/packaged within such a box.

BACKGROUND OF THE INVENTION

Boxes for receiving a luminaire—e.g. for shipment and handling purposes—are well-known in the prior art. These boxes are generally made of cardboard and are usually folded to delimit a space for receiving and supporting a luminaire within the box. The luminaire can thus be easily carried to a location where this luminaire should be installed, e.g. in or at a surface (wall, ceiling, etc.) like in a recess or opening in a ceiling. Installation of luminaires at/in ceilings can be difficult due to the fact that the luminaire weight must be supported by the assembler while wiring is connected. This usually requires wiring connection being made one-handed while the other hand is busy with supporting the luminaire. Alternatively, two assemblers are required. Further, installation of luminaires at/in a ceiling requires the installation process carried out while being up a ladder or on an installation platform.

SUMMARY OF THE INVENTION

It is thus an object of the present invention to provide boxes for receiving a luminaire as well as a method for installing the luminaire, which allow easy and safe installation of a luminaire.

The object is accomplished by means of the independent claims. The dependent claims advantageously study further the central idea of the present invention.

According to an aspect of the present invention, there is provided a box for receiving a luminaire. Said box comprises a box body delimiting a space for receiving and supporting a luminaire within the box or box body. The box further comprises an opening delimited by a circumferential edge of the box body for putting the luminaire into and taking the luminaire out of the box (i.e. for packing and unpacking the box with the luminaire). The box further comprises a tap. This tap is configured for hanging-up the box carrying the luminaire at a corresponding receiving section. The tap is thus laid out to carry the weight of the box and the luminaire (to be) supported therein. The tap comprises a connection portion extending from the box body. The tap further comprises a hanger portion being distant from the box body and laterally extending from the connection portion.

Providing a box with an (integrally formed) tap allows the box together with the luminaire being received by (e.g. inserted and "hooked" in) an installation opening or attached to any other kind of a (structural) receiving section. Hence, an assembler can easily hang up the box at a location of installation and preferably in an installation opening for receiving the luminaire in a way that the box carries the luminaire. As the luminaire is thus supported at a location close to the installation spot, an assembler does not need to support the luminaire with his hands thus having both hands free for electrical and mechanical installation of the luminaire. Hence, the box—via the hung-up tap—supports the weight of the luminaire to aid the wiring process. This allows for an easy and safe installation by only one assembler.

The hanger portion may laterally extend from the connection portion at two opposite sides so that the tap preferably has an L-shape, a hook-shape, a cross-shape, a T-shape or an anchor-shape. This spread layout of the hanger portion allows for a safe (temporary) mounting of the box to a receiving section (e.g. an installation opening for receiving a luminaire).

The hanger portion can be provided at a distal end of the connection portion with respect to the box body. This allows for a space-saving layout of the tap.

The hanger portion can be collapsibly and preferably hingedly connected to the connection portion to thus allow the tap to collapse into a folded state such that the lateral extension of the tap is reduced. This allows the tap to be reduced in size for easy insertion of the tap into and removal of the tap out of a receiving section (e.g. an installation opening). When being inserted, the tap can be unfolded/expanded again to thus extend the lateral extension thereof. In the unfolded state of the hanger, the box can thus be safely received at/in a corresponding receiving section.

The tap may be configured such that the hanger portion is biased towards the unfolded state so that the hanger portion is securely positioned in an expanded mounting state (i.e. the unfolded state of the tap) when being in use.

The tap can be provided at and extend from the edge of the box body delimiting the opening. Hence, when being hung-up, the box can be oriented in a more or less angled manner such that the opening is at least partially directed sidewards and thus accessible from a side thereof. This allows for the luminaire to be safely stored within the box body while the space—and thus the luminaire—is still easily accessible for an assembler even when the box is hung-up via the tap.

The box may further comprise at least one flap for selectively closing and exposing at least part of the opening. In a preferred embodiment, the flap is provided at and extends from the edge of the box body delimiting the opening. Hence, the luminaire can be completely housed and stored within the box. The box thus completely surrounding the luminaire allows for sufficient protection of the luminaire during shipment, transportation and handling.

At least one of the flaps can form part of the connection portion of the tap. In a preferred embodiment, at least one of the flaps is configured as the said connection portion. Hence, the flap can be used as or as an extension of the connection portion to thus allow the box body being positioned at a desired distance from the installation opening or receiving section for hanging up the box via the tap with a minimum of material usage. The tap or parts thereof can be used for closing the opening so that the overall size and number of parts of the box can be reduced.

The box body and the tap and, if present, also the flap are integrally formed with each other. For instance, the box can be made of cardboard. Hence, commonly known manufacturing methods as well as materials for such boxes can be used.

According to another aspect, the present invention relates to a method for installing a luminaire, in particular a built-in luminaire, comprising the following steps: in a first step, a box according to the present invention is provided. The box supports a luminaire within the space of its box body. In a second step, the tap of the box is attached to (e.g. inserted into) a receiving section (e.g. an installation opening for receiving the luminaire) via the hanger portion to carry the luminaire in the box body. Hence, the hanger portion can be easily attached to the receiving section, e.g., by being inserted and "hooked" in an installation opening. In a third step, the luminaire is electrically installed which includes, for instance, a wiring connection of the luminaire. In a fourth step, the tap is removed from the receiving section and the box is removed from the luminaire. In a last step, the luminaire is installed in or at the receiving section, e.g. by being inserted into the installation opening.

The box thus allows for an easy installation of a luminaire, like a built-in luminaire, as it carries the luminaire during electrical installation which can thus be easily carried out by one person having both hands free for installation of said luminaire.

The tap can be collapsed into a folded state when being attached to (e.g. inserted into) and removed from the receiving section (e.g. installation opening) by folding the hanger portion with respect to the connection portion such that the lateral extension of the tap is reduced. This allows for easy insertion and removal of the tap with respect to a receiving section in the form of an installation opening.

The opening of the box may be exposed by removing the at least one flap from the opening either before inserting the tap into the installation opening or before removing the box from the luminaire. Hence, the luminaire can be safely stored inside the box until any desired installation step.

The box may, of course, comprise more than one tap which allows for hanging up the box either via different taps, respectively, or by aid of more than one tap at once to thus increase the carrying capacity of the box being hung up via the taps. Moreover, it is also possible to provide different taps having different dimensions/layouts (e.g. a different length of the connection portion and/or the hanger portion) to provide different hanger assemblies to thus increase the possible applications of the box.

Further features, advantages and objects of the present invention would come apparent for the skilled person when reading the following detailed description of embodiments of the present invention, when taking into conjunction with the figures of the enclosed drawings.

DETAILED DESCRIPTION

Figure 1:
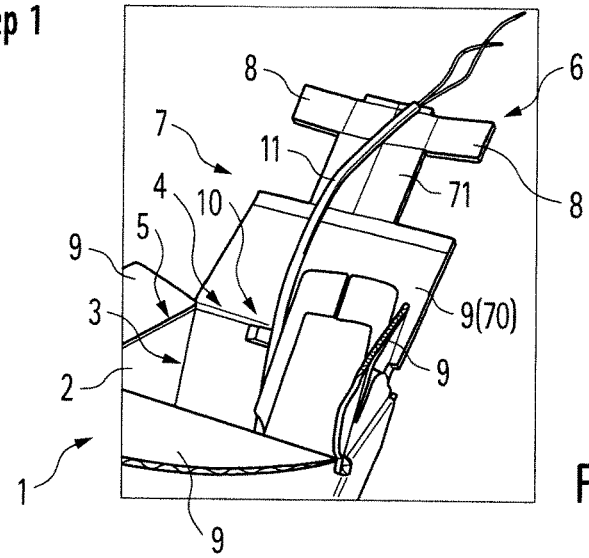
FIG. 1 shows a perspective view of a box according to the present invention in an open state and carrying a luminaire.
Figure 2:
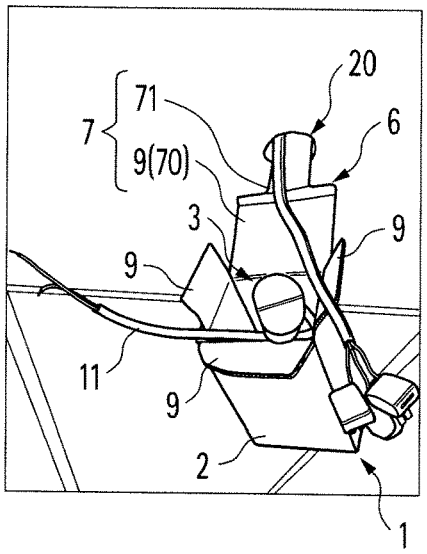
FIG. 2 shows a perspective view of the box according to FIG. 1 being hung-up in an installation opening of a ceiling via the tap before electrical installation.

The figures show different steps of a method for installing a luminaire 10, in particular a built-in luminaire, which is supported in a box 1 according to the present invention. The box 1 is shown in FIGS. 1 through 4 and described in following.

The box 1 is configured to receive a luminaire 10. The box 1 is preferably made of cardboard but can, of course, be made of any other suitable material.

The box 1 has a box body 2 delimiting a space 3 for receiving and supporting (i.e. carrying) the luminaire 10 within the box body 2. The box 1 further comprises an opening 4 delimited by a circumferential edge 5 of the box body 2 for putting the luminaire 10 into the box 1 (i.e. packing the box 1) and taking the luminaire 10 out of the box 1 (i.e. unpacking the box 1). The box body 2 as well as the opening 4 and, in general, the box 1 can have any shape and dimensions. The shown box 1 has a cubical shape but can, of course, have any other shape.

The box 1 further comprises a tap 6 which is suitable for hanging-up the box 1 carrying the luminaire 10 at a corresponding receiving section 20, like a receiving opening for receiving and installing the luminaire 10.

The tap 6 comprises a connection portion 7 extending from the box body 2. The tap 6 further comprises a hanger portion 8 being distant from the box body 2 and laterally extending from the connection portion 7. In the shown embodiment, the hanger portion 8 laterally extends from the connection portion 7 at two opposite sides so that the tap 6 preferably has a T-shape or anchor-shape. As can be seen in FIG. 1, the hanger portion 8 may therefore be provided at a distal end of the connection portion 7 with respect to the box body 2. Dependent on the position of the hanger portion 8 with respect to the connection portion 7, the tap may alternatively have an L-shape, a hook-shape, a cross-shape or the like.

To allow for easy attachment to (e.g. insertion into) and removal from (e.g. out of) a receiving section 20 like an installation opening, the hanger portion 8 preferably is collapsibly and more preferably hingedly connected to the connection portion 7 to allow the tap 6 to collapse into a folded state such that the lateral extension of the tap 6 is reduced. In a most preferred embodiment, the hanger portion 8 is biased towards the unfolded/expanded state. This can be obtained either by the material characteristics of the box 1 or tap 6 and/or the layout of the tap 6 and/or by additional biasing means.

The box may further comprise at least one flap 9 for selectively closing and exposing at least part of the opening 4. Therefore, the flap 9 may be provided at and extend from the edge 5 of the box body 2 delimiting the opening 4.

The tap 6 can be provided at and extend from the edge 5 of the box body 2 delimiting the opening 4. In a preferred embodiment as shown in the figures, at least one of the flaps 9 can form part of the connection portion 7 of the tap 6. The flap 9 thus preferably forms a proximal end 70 of the connection portion 7, which is here provided at the circumferential edge 5 of the box body 2. A distal end 71 of the connection portion 7 extends from the proximal end 70 (i.e. from the flap 9); here from a side of the flap 9 being opposite to the box body 2. The hanger portion 8 is here provided at—i.e. laterally extends from—the distal end 71.

Alternatively, at least one of the flaps 9 can be configured as the connection portion 7 of the tap 6. In other words, the connection portion 7 is designed such that it can also be used as a flap 9 of the box 1 for selectively closing and exposing at least part of the opening 4.

In a preferred embodiment, the box body 2 and the tap 6 as well as the flap 9 are integrally formed with each other and preferably made of cardboard so that common materials and manufacturing processes can be used for providing the box 1.

In the following, a method for installing a luminaire 10, in particular a built-in luminaire, is described.

First of all, a box 1 according to the present invention is provided (Step 1). Said box 1 carries or supports a luminaire 10 within the space 3 of the box body 2 as can be seen in FIG. 1. In FIG. 1, flaps 9 for selectively closing the opening 4 are already moved (e.g. swung open) in a position to expose the opening 4 to thus access the luminaire 10 stored within the box 1.

In a next step, the tap 6 of the box 1 is attached to a receiving section 20—here inserted into an installation opening 20 for receiving the luminaire 10—via the hanger portion 8 to carry the luminaire 10 in the box body 2 (Step 2). Here, the hanger portion 8 is inserted and "hooked" in the installation opening 20. For inserting the tap 6 into the receiving section 20, the tap 6 can be collapsed into a folded state by folding the hanger portion 8 with respect to the connection portion 7 such that the lateral extension of the tap 6 is reduced. After being inserted, the tap 6 may expand preferably automatically into its unfolded state to thus provide the hanger portion 8 such that it can be received by/in the receiving section 20 to thus carry the box 1 with the luminaire 10 at the installation spot.

Figure 3:
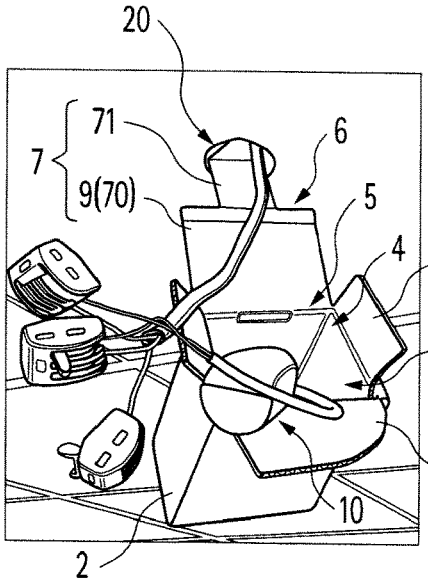
FIG. 3 shows the box according to FIG. 2 after electrical installation of the luminaire supported in the box body.
Figure 4:
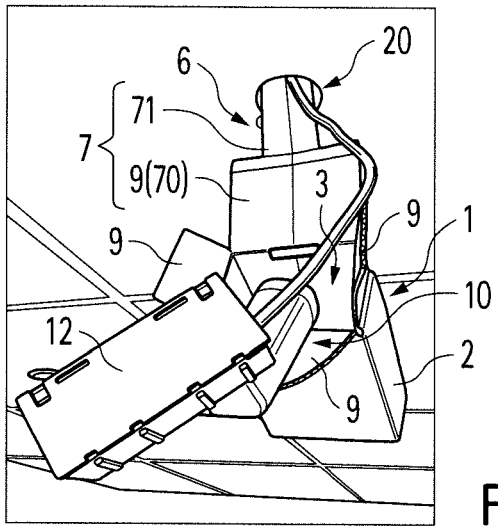
FIG. 4 shows a perspective view of the box according to FIG. 3 after having applied a strain relief as part of the electrical installation.

In the next step shown in FIGS. 3 and 4, electrical installation of the luminaire 10 is carried out. Therefore, the wires 11 of the luminaire 10 are electrically connected (FIG. 3; Step 3*a*) and a strain relief 12 for the wiring 11 can optionally be applied (FIG. 4; Step 3*b*).

Figure 5:
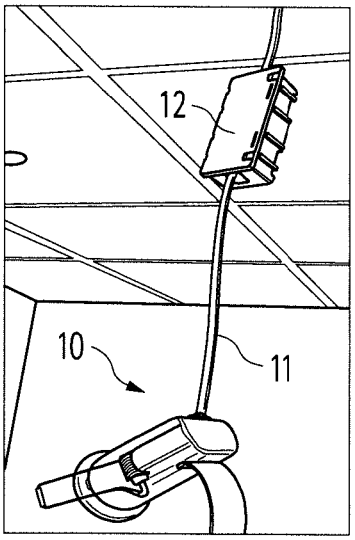
FIG. 5 shows a perspective view of the luminaire according to FIG. 4 after having removed the tap from the installation opening and the box from the luminaire.
Figure 6:
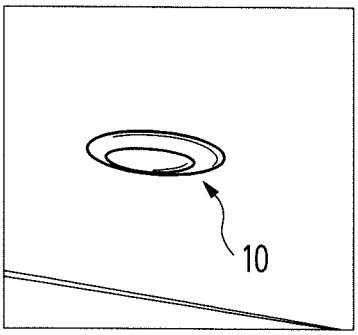
FIG. 6 shows the luminaire according to FIG. 5 after being installed (i.e. fit) in the installation opening in the ceiling.

In a next step, the tap 6 is removed from the receiving section (installation opening 20). Therefore, the tap 6 can be simply pulled away from (e.g. out of) the receiving section 20 or the hanger portion 8 can manually be manipulated such that the tap 6 is collapsed into its folded state so that the lateral extension of the tap 6 is reduced for removal of the tap 6 from the receiving section 20. Then, the box 1 is removed from the electrically connected luminaire 10 as shown in FIG. 5 (Step 4).

In a final step, the luminaire is installed in or at the receiving section 20; here inserted in the installation opening 20 (Step 5).

As the box 1 supports/carries the luminaire 10 during the whole installation process, installation can be carried out by one person having both hands free for connection of the wiring. This allows for an easy and safe installation of a luminaire 10.

The present invention is not limited by the embodiments as described herein above as long as being covered by the appended claims. All the features of the embodiments described herein above can be combined and interchangeably provided in any possible way. For instance, the box 1 according to the present invention can comprise one or more taps 6 as described herein above. These taps 6 can then be identical or can differ from each other to provide a number of desired taps 6 increasing the hanging capabilities of the box 1 according to the present invention. Further, box 1 as well as its components (i.e. the box body 2, the space 3, the opening 4, the circumferential edge 5, the tap 6 and its connection portion 7 and hanger portion 8 and the flaps 9) are not limited by its dimension, shape, form and material.

The invention claimed is:

1. A box (1) containing an uninstalled, built-in luminaire (10) with unconnected wiring that is configured to be electrically and mechanically installed in an installation opening in a ceiling, comprising:

a box body (2) delimiting a space (3) receiving and supporting said uninstalled, built-in luminaire (10) with unconnected wiring within the box body (2);

an opening (4) delimited by a circumferential edge (5) of the box body (2) for putting the luminaire (10) into and taking the luminaire (10) out of the box (1); and tap means (6) for temporarily hanging-up the box (1) carrying the luminaire (10) below the installation opening in the ceiling when the box is opened to expose the luminaire being held in the box and enable the unconnected wiring to be electrically installed while the luminaire is held in the box, said tap means (6) comprising a connection portion (7) extending from the box body (2), and a hanger portion (8) being distant from the box body (2) and laterally extending from the connection portion (7);

wherein the connection portion extends upward from the box when the box is opened so that the hanger portion is capable of being inserted into and hung in the installation opening of the ceiling in order to hang the box and luminaire temporarily from the installation opening.

2. The box (1) according to claim 1, wherein the hanger portion (8) laterally extends from the connection portion (7) so that the tap (6) has an L-shape, a hook-shape, a cross-shape, a T-shape, or an anchor-shape.

3. The box (1) according to claim 1, wherein the hanger portion (8) is provided at a distal end of the connection portion (7) with respect to the box body (2).

4. The box (1) according to claim 1, wherein the hanger portion (8) is collapsibly and hingedly connected to the connection portion (7) to allow the tap (6) to collapse into a folded state such that the lateral extension of the tap (6) is reduced.

5. The box (1) according to claim 4, wherein the hanger portion (8) is biased towards the unfolded state.

6. The box (1) according to claim 1, wherein the tap (6) is provided at and extends from the edge (5) of the box body (2) delimiting the opening (4).

7. The box (1) according to claim 1, wherein the box (1) further comprises at least one flap (9) for selectively closing and exposing at least part of the opening (4), and the flap (9) is provided at and extends from the edge (5) of the box body (2) delimiting the opening (4).

8. The box (1) according to claim 7, wherein at least one of the flaps (9) forms part of or is configured as the connection portion (7) of the tap (6).

9. The box (1) according to claim 7, wherein the box body (2), the tap (6) and the flap (9) are integrally formed with each other.

10. The box (1) according to claim 9, wherein the box (1) is made of cardboard.

11. The box according to claim 1 wherein the box completely surrounds the luminaire when the luminaire is packed in the box for shipping.

12. A box (1) containing an uninstalled, built-in luminaire (10) with unconnected wiring that is configured to be electrically and mechanically installed in an installation opening in a ceiling, comprising:

a box body (2) delimiting a space (3) receiving and supporting said uninstalled, built-in luminaire (10) with unconnected wiring within the box body (2);

an opening (4) delimited by a circumferential edge (5) of the box body (2) for putting the luminaire (10) into and taking the luminaire (10) out of the box (1), a flap (9) for selectively closing and exposing the opening (4) of the box, the flap (9) being provided at and extending from the circumferential edge (5) of the box body (2) delimiting the opening (4); and a tap (6) for temporarily hanging-up the box (1) carrying the luminaire (10) below the installation opening in the ceiling in an angled manner, the tap (6) and the flap (9) being integrally formed with each other and the flap forming part of the tap, said tap being configured to carry the weight of the box and the luminaire, the tap comprising a connection portion (7) extending from the box body (2) having a proximal end (70) and a distal end (71), wherein the flap (9) forms at least a part of the proximal end (70), and a hanger portion (8) at the distal end of the connection portion (7) with respect to the box body (2) and laterally extending from the connection portion (7), wherein said hanger portion has an unfolded state and a folded state and is collapsibly and hingedly connected to the distal end of connection portion (7) such that it can be collapsed into a folded state to reduce the lateral extension of the distal end of the tap;

wherein said tap extends upward from the box when the box is opened and before the box is opened the flap covers the opening in the box and the hanger portion is in an unfolded state, and further wherein the hanger portion is adapted to be collapsed into the folded state to insert the hanger portion into the installation opening in the ceiling and then expanded again to an unfolded state in order to temporarily hang-up the box carrying the luminaire from the installation opening.

13. The box (1) according to claim 12, wherein the hanger portion (8) laterally extends from the connection portion (7) so that the tap (6) has an L-shape, a hook-shape, a cross-shape, a T-shape, or an anchor-shape.

14. The box (1) according to claim 12, wherein the hanger portion (8) is biased towards the unfolded state.

15. The box (1) according to claim 12 wherein the box (1) is made of cardboard.

16. The box according to claim 12 wherein the box completely surrounds the luminaire when the luminaire is packed in the box for shipping.

* * * * *